US012790546B2

(12) United States Patent
Nadeau et al.

(10) Patent No.: US 12,790,546 B2
(45) Date of Patent: Nov. 10, 2026

(54) METHOD FOR PYROLYZING LIGNEOUS BIOMASS

(71) Applicant: GROUPE ONYM, Adstock (CA)

(72) Inventors: Yvon Nadeau, Adstock (CA); Mustapha Ouyed, Montreal (CA)

(73) Assignee: GROUPE ONYM, Adstock (CA)

( * ) Notice: Subject to any disclaimer, the term of this patent is extended or adjusted under 35 U.S.C. 154(b) by 136 days.

(21) Appl. No.: 18/846,135

(22) PCT Filed: Jun. 15, 2022

(86) PCT No.: PCT/IB2022/055534
§ 371 (c)(1),
(2) Date: Sep. 11, 2024

(87) PCT Pub. No.: WO2023/175384
PCT Pub. Date: Sep. 21, 2023

(65) Prior Publication Data

US 2025/0179368 A1 Jun. 5, 2025

(30) Foreign Application Priority Data

Mar. 18, 2022 (CA) ..... CA 3152668

(51) Int. Cl.
*C10B 53/02* (2006.01)
*C10B 49/18* (2006.01)
*C10B 57/10* (2006.01)

(52) U.S. Cl.
CPC ..... *C10B 53/02* (2013.01); *C10B 49/18* (2013.01); *C10B 57/10* (2013.01)

(58) Field of Classification Search
CPC ..... C10B 49/18; C10B 53/02; C10B 57/10
See application file for complete search history.

(56) References Cited

U.S. PATENT DOCUMENTS 4,160,719 A * 7/1979 Pollock ..... C10B 53/06 75/235
5,792,340 A * 8/1998 Freel ..... C10B 49/20 208/126

(Continued)

FOREIGN PATENT DOCUMENTS

CA 2009021 A1 7/1991
CN 203212525 U 9/2013

(Continued)

OTHER PUBLICATIONS

Christophe Kornmayer, "Verfahrenstechnische untersuchungen zur schnellpyrolyse von lignocellulose im doppelschnecken-mischreaktor," Thèse de doctorat Dissertation, Nov. 6, 2009, pp. 1-297, Karlsruher Institut for Technologie (KIT).

(Continued)

*Primary Examiner* — Jonathan Miller
(74) *Attorney, Agent, or Firm* — H&I PARTNERS; Chai Im; C. Andrew Im

(57) ABSTRACT

A method for pyrolyzing ligneous biomass includes mechanically grinding ligneous biomass into particles with a size of less than 3 $cm^3$ and conveying the ligneous particles to a dryer. The ligneous particles coming from the dryer is heated in a horizontal-trough pyrolysis reactor having an oxygen level of less than 15%. The reactor includes a first inlet for the ligneous particles and a second inlet for heat-transfer beads. The reactor is configured to make the ligneous particles react so as to have a first output of a mixture of heat-transfer beads and pyrolyzed ligneous particles and a second output of the pyrolysis gas. The residence time in the reactor is at least 20 seconds and the heat-transfer beads are heated in a bead regenerator.

8 Claims, 3 Drawing Sheets

(56) References Cited

U.S. PATENT DOCUMENTS

| | | | | |
|---|---|---|---|---|
| 5,961,786 | A * | 10/1999 | Freel | C10B 49/22 208/126 |
| 8,100,990 | B2 * | 1/2012 | Ellens | C10L 5/447 44/589 |
| 8,821,692 | B2 * | 9/2014 | Henrich | C10B 49/16 585/242 |
| 9,920,252 | B2 * | 3/2018 | Moss | C10G 9/28 |
| 9,994,774 | B2 * | 6/2018 | Li | C10B 47/30 |
| 10,611,966 | B2 * | 4/2020 | Ackerson | C10K 1/18 |
| 2008/0006519 | A1 * | 1/2008 | Badger | C10B 49/20 48/127.3 |
| 2010/0163395 | A1 * | 7/2010 | Henrich | C10B 53/02 201/2.5 |
| 2011/0278149 | A1 * | 11/2011 | Hornung | C10B 57/02 201/12 |
| 2013/0075072 | A1 * | 3/2013 | Kulprathipanja | C10B 53/02 165/185 |
| 2013/0256113 | A1 * | 10/2013 | Tumiatti | C10B 49/14 422/187 |

FOREIGN PATENT DOCUMENTS

| | | | |
|---|---|---|---|
| CN | 104046373 | A | 9/2014 |
| EP | 3093331 | A1 | 11/2016 |
| WO | 2010089031 | A2 | 8/2010 |
| WO | 2010130988 | A1 | 11/2010 |
| WO | 2012041489 | A1 | 4/2012 |

OTHER PUBLICATIONS

Wade A. Amos, "Report on Biomass Drying Technology," National Renewable Energy Lab (NREL), Nov. 1998, pp. 1-35, Golden, Colorado, USA.

Tony Bridgwater, "Challenges and Opportunities in Fast Pyrolysis of Biomass: Part I," Johnson Matthey Technology Review 2018, pp. 118-130, vol. 62, No. 1.

Breanna Marmur et al., Scale effects on double-screw granular mixing, Powder Technology, Aug. 2017, pp. 74-88, vol. 321.

J. N. Brown et al., "Process optimization of an auger pyrolyzer with heat carrier using response surface methodology," Bioresource Technology, 2012, pp. 405-414, vol. 103, No. 1.

Magnus Stahl et al., "Industrial processes for biomass drying and their effects on the quality properties of wood pellets," Biomass and Bioenergy, 2004, pp. 621-628, vol. 27, No. 6.

* cited by examiner

METHOD FOR PYROLYZING LIGNEOUS BIOMASS

RELATED APPLICATIONS

This application is a § 371 application of PCT/IB2022/055534 filed Jun. 15, 2022, which claims priority from Canadian Patent Application No. 3,152,668 filed Mar. 18, 2022, each of which is incorporated herein by reference in its entirety.

TECHNICAL FIELD OF THE INVENTION

The present invention relates to a method for pyrolyzing ligneous biomass. It applies in particular to reprocessing wood residues (branches, leaves, chips, sawdust, etc) for the purpose of producing bioenergies and bioproducts and helping to reduce greenhouse gas emissions.

BACKGROUND OF THE INVENTION

Some documents of the prior art also propose pyrolysis methods.

For example, the publication document US2010163395 is known, which describes a method for the rapid pyrolysis of lignocellulosic, comprising several steps: a) mechanically grinding into lignocellulosic particles; b) drying and preheating lignocellulosic particles; e) mixing the lignocellulosic particles with heat-transfer particles so as to provide a mixture; d) heating the heat-transfer particles, prior to the mixing, to a certain temperature; and e) heating pyrolysis condensate and pyrolysis gas in a pyrolysis reactor so as to provide pyrolysis coke.

However, the way in which the heat-transfer medium is managed in terms of heating and management is not optimum.

The aim of the present invention is to provide, at the core of the reactor, optimum pyrolysis in order to ensure better homogeneity of the heat exchange and to provide an optimum pyrolysis reaction.

OBJECT AND SUMMARY OF THE INVENTION

The present invention aims to remedy these drawbacks with a completely innovative approach.

More precisely, the objective of the invention is to significantly improve the efficiency of the pyrolysis reaction and to optimize the reaction extracts (pyrocarbon, condensates, combustion gas etc.).

These objectives, as well as others that will emerge hereinafter, are achieved, according to a first aspect, by means of a method for pyrolyzing ligneous biomass, remarkable in that it includes the following steps:

a) mechanically grinding ligneous biomass into ligneous particles of less than 3 $cm^3$;

b) conveying the ligneous particles to a dryer operating at a temperature of at least 80° C. configured to have a moisture level of the ligneous particles of less than 10% at the outlet;

c) heating the ligneous particles coming from the dryer, in a horizontal-trough pyrolysis reactor having an oxygen level of less than 15%, including a first inlet for the ligneous particles and a second inlet for heat-transfer beads, the heating is configured to establish a temperature inside the reactor of between 400° C. and 660° C. and configured to make the ligneous particles react so as to have a first output of a mixture of heat-transfer beads and pyrolyzed ligneous particles the residence time in the reactor is at least 20 seconds and a second output of the pyrolysis gas;

d) heating the heat-transfer beads in a bead regenerator, prior to the heat-transfer beads entering the reactor, at a temperature of between 400° C. and 650° C. for at least 40 seconds.

By virtue of these elements of the method, the heat transfer to the ligneous biomass is increased, continuously and reliably.

The aim of the method is to control not only the temperature of the heat-transfer medium but also the duration of the heating time, in order to ensure that a temperature of 550° C. to 660° C. is reached at the center of the heat-transfer medium rather than solely at the surface thereof.

Thus, the heat-transfer medium stores the maximum possible amount of heat energy, guaranteeing better capacity of heat transfer to the biomass in the pyrolysis reactor. The method was designed so that this targeted temperature of the beads at the entry to the reactor can be ensured all the time, in an environment in continuous movement.

It is also a case of maximizing the contact surface between the heat-transfer medium and the biomass, by reducing the void spaces when the biomass mixes with the heat-transfer medium.

Advantageously, the invention is implemented according to the embodiments and variants disclosed hereinafter, which should be considered individually or according to any technically-feasible combination.

In one embodiment, said method furthermore includes a step of separating the heat-transfer beads and the pyrolyzed ligneous particles by sieving, said sieving includes two outlets, a first one for the heat-transfer beads and a second one for biocarbon.

Thus, the sieving includes a grille that separates the heat-transfer beads and the pyrolyzed ligneous particles. The grille is slightly inclined to enable, by gravity effect, the heat-transfer beads to roll and bounce on the grille, which detaches the pyrolyzed ligneous particles, which fall through the grille by gravity effect.

In one embodiment, said method furthermore includes a step of conveying the mixture of heat-transfer beads and pyrolyzed ligneous particles in a vertical conveyor to the sieving.

In one embodiment, during step b), the dryer is a dryer of the rotary type and operates with combustion gases.

In one embodiment, during step d), the bead regenerator consisting of a main cylinder through which cylindrical tubes pass in which the heat-transfer beads pass.

In one embodiment, during step d), the tubes of the regenerator are positioned substantially vertically.

In one embodiment, during step d), the tubes of the regenerator are in a spiral.

In one embodiment, the heat-transfer beads used in one of the steps of said method are made from metal, ceramic or a hard material having a diameter greater than 3 mm. This dimension makes it possible to have a sufficient diameter to store the heat and allows good restoration of this heat in the reactor.

In one embodiment, the heat-transfer beads used in one of the steps of said method have at least two different diameters with a diameter ratio of less than or equal to 0.5.

Thus, the mixture affords better distribution of the heat and affords better global efficiency.

In one embodiment, said method furthermore includes a step wherein the pyrolysis gas coming from the reactor is conveyed in a condensation step configured to extract liquid phases.

In one embodiment, at step c), the pyrolysis reactor includes a zone for temporary storage of the pyrolysis gases, wherein the storage zone is at least equal to 30% of the total volume of the reactor.

Thus, the temporary storage zone serves to eliminate the greatest proportion of biocarbon in the gases the hood in order to leave time for the biocarbon dust to be deposited while the gases emerge upwards.

BRIEF DESCRIPTION OF THE FIGURES

Other advantages, aims and features of the present invention will appear from the following description made, for explanatory and non-limiting purposes, with reference to the appended drawings, wherein.

DESCRIPTION OF THE EMBODIMENTS

Figure 1:
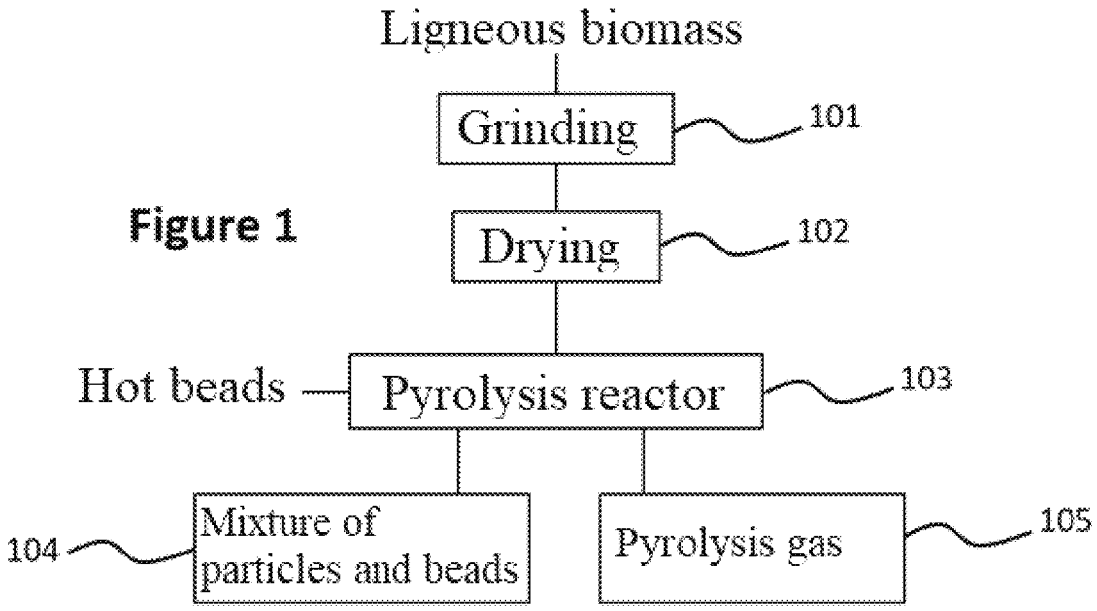
FIG. 1 shows, in logic diagram form, steps implemented in a particular embodiment of the method that is the object of the present invention.

FIG. 1 shows, in logic diagram form, implemented steps of the method.

By this Figure, the principle of the invention is presented hereinafter.

The reprocessed raw material, consisting essentially of residues of pruning and trimming operations (branches, leaves, chips, sawdust, etc.), is delivered to a building by lorries. The biomass is deposited on a moving floor at the unloading dock.

According to one example, the content of the lorry is thus directly unloaded onto the first skip in a series of three moving-bottom skips.

The ligneous biomass is next conveyed to a grinding step 101.

The grinding step is for example a conventional hammer grinder, adapted to the requirements of flow rate and size of the wood. The size of the ligneous particles obtained is less than 3 $cm^3$.

The ground biomass is next transferred to a so-called ground-biomass skip, for where it is conveyed to the drying step 102. The latter takes place inside a rotary dryer.

The dryer operates at a temperature of at least 80° C. and is configured to have a moisture level of the ligneous particles of less than 10% at the outlet.

The dryer is installed in a closed container, supplied with heat by the combustion gases coming from a combustion chamber presented hereinafter.

Once dried, the biomass is conveyed to the dried-biomass skip before it is transferred to a thermolysis reactor. The latter skip is covered with a sheet-metal roof in order to preserve the quality of the product and to reduce losses in the air.

In terms of measures for preventing environmental contamination, it must be noted that all the biomass is stored in metal skips and that these are placed on a dry floor, such as a concrete slab, the whole entirely within a building, sheltered from bad weather and wind. There is therefore no provision for having biomass stored outside or which can pose an environmental threat.

The emissions of wood particles are controlled through a series of cyclones, three for the grinder and one for the dryer. The particles captured by the cyclones are deposited in the appropriate skip in order ultimately to be transferred to the pyrolysis reactor.

The following step is to heat the ligneous particles in an oxygen-free horizontal-trough pyrolysis reactor 103.

The targeted pyrolysis reaction is initiated when the dried biomass is heated to a temperature of around 450° C., in a low-oxygen environment. The horizontal-trough reactor includes a cylinder in which a worm is inserted, where the biomass is mixed with steel heat-transfer beads in order to optimize the heat transfer and the thermolysis reaction.

Thus, the dried biomass coming from the dried-biomass skip is taken by conveyor to the pyrolysis reactor. In parallel, heated steel heat-transfer beads are also conveyed to the reactor to be mixed with the dried biomass.

Under the required conditions, the pyrolysis reaction takes place and the biomass generates pyrolysis gases 105 that are transferred to the condensation step, detailed hereinafter.

At the end of the reactor, the biomass mixture reacts and the steel heat-transfer beads are next recovered by a vertical conveyor, this is the mixture 104 composed of the pyrolyzed ligneous particles and heat-transfer beads.

Next, the biomass is separated from the steel beads by gravity through metal grilles, and then stored in stacks to be sold as biocarbon.

The steel beads resume the closed loop of the heating-reaction-separation.

Figure 2:
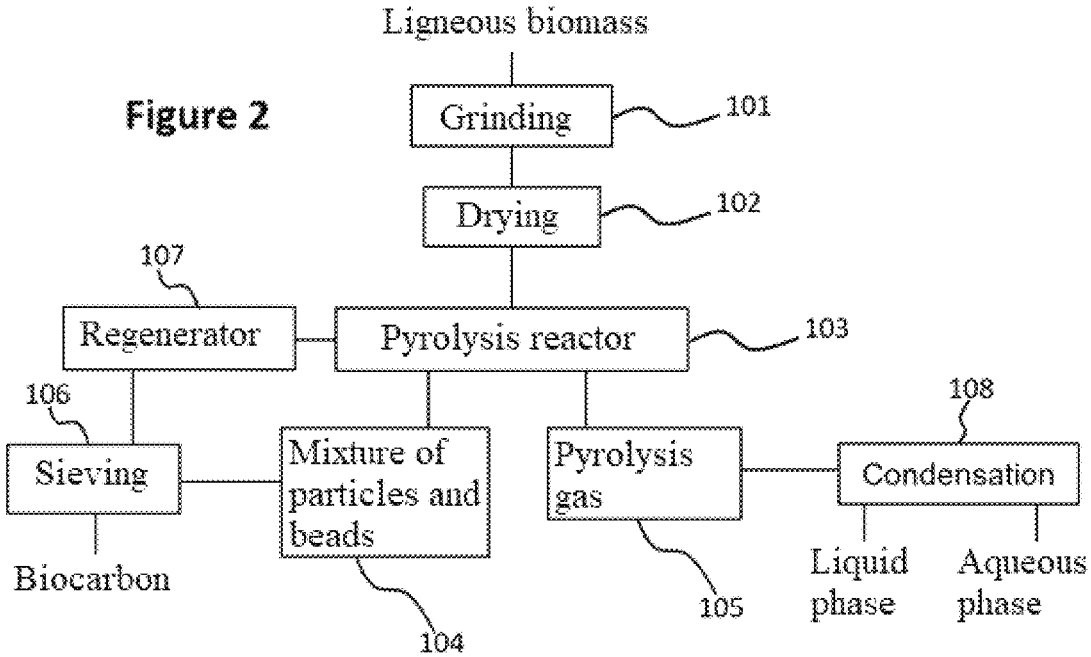
FIG. 2 shows, in logic diagram form, steps implemented in another particular embodiment of the method that is the object of the present invention.

FIG. 2 shows, in logic diagram form, implemented steps of the method according to another embodiment, which specifies certain steps.

FIG. 2 repeats the elements of FIG. 1. At the outlet of the reactor the pyrolysis gases 105 go towards a condensation step 108. The pyrolysis gases 105 are initially conveyed to the oil quenching. The purpose of this equipment is to condense the most biooil gas possible, which is also a marketable product and is stored temporarily in a steam-heated double-wall stainless-steel tank. According to one example, it is located outside the building.

The gases that have not condensed in the oil quenching are next directed to the water quenching, the purpose of which is to condense mainly water. This water, containing a particular acetic acid, is known by the term wood vinegar. This is a product intended for marketing and is stored temporarily in a steam-heated double-wall stainless-steel tank. According to one example, it is located outside the building.

The residual gases that also have not condensed in the quenchings, the renewable gases, are then transferred to the combustion chamber to generate part of the energy necessary for the drying and reaction phases.

The mixture 104 composed of the pyrolyzed ligneous particles and heat-transfer beads is directed by a vertical conveyor to the sieving step 106. Sieving is a step for separating the heat-transfer beads and the pyrolyzed ligneous particles. The pyrolyzed ligneous particles and the heat-transfer beads are separated by gravity through metal grilles, the beads remaining above the grille whereas the pyrolyzed ligneous particles fall by gravity effect.

The pyrolyzed ligneous particles are stored in bags to be sold as biocarbon.

The heat-transfer beads, after the sieving step, sent to the step of the regenerator 107.

The bead regenerator consists of a main cylinder through which cylindrical tubes pass in which the heat-transfer beads pass. According to one example, the tubes are positioned substantially vertically. According to another example, the tubes are in the form of a spiral.

Figure 3:
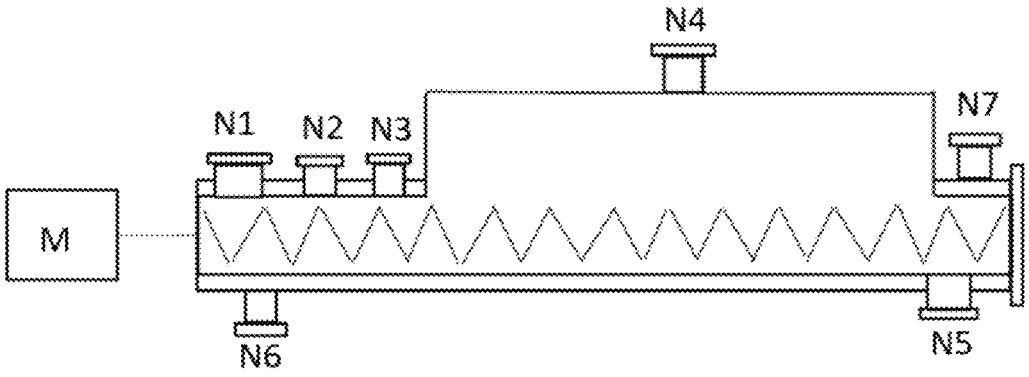
FIG. 3 shows an example of a reactor according to a particular embodiment of the method that is the object of the present invention.

FIG. 3 shows an example of a reactor used at the step c) of heating the ligneous particles.

The horizontal-trough reactor serves for pyrolyzing the previously dried biomass. The biomass and heat-transfer beads are introduced to the reactor through a respective entry N1 and N2 at one of the ends of the reactor. By means of a worm actuated by a motor M, the heat-transfer beads and the biomass are mixed and transported to the other end of the reactor. All along the reactor, the biomass is pyrolyzed by means of the energy transferred by the beads, which will previously have been heated in a regenerator.

The pyrolysis produces biocarbon, which will emerge at N5 with the beads at a port at the end of the reactor. Synthesis gas is recovered at N4.

A temporary storage zone is created. The size of this temporary storage zone is at least equal to one third of the total volume of the reactor.

The pyrolysis gases entrain the biocarbon dusts. The temporary storage zone, called a raised hood, serves to eliminate the greatest proportion of biocarbon in the gases the hood in order to leave time for this dust to be deposited while the gases emerge through the top of the hood.

A hot-gas inlet N6 and a hot-gas outlet N7 are positioned at the ends of the reactor.

The oil vapors are also produced and conveyed to a pyrolysis-oil and wood-vinegar recovery unit.

In addition to the biomass, according to another example, the portion of oil having a biocarbon concentration exceeding 1% in the pyrolysis oil (substrate) coming from the oil-condensation unit is recycled at the reactor to be pyrolyzed once again at N3.

According to a variant, a jacket is installed around the reactor in order to circulate therein hot gas coming from the outlet of the bead regenerator. This for the purpose of keeping the walls of the reactor hot.

Figure 4:
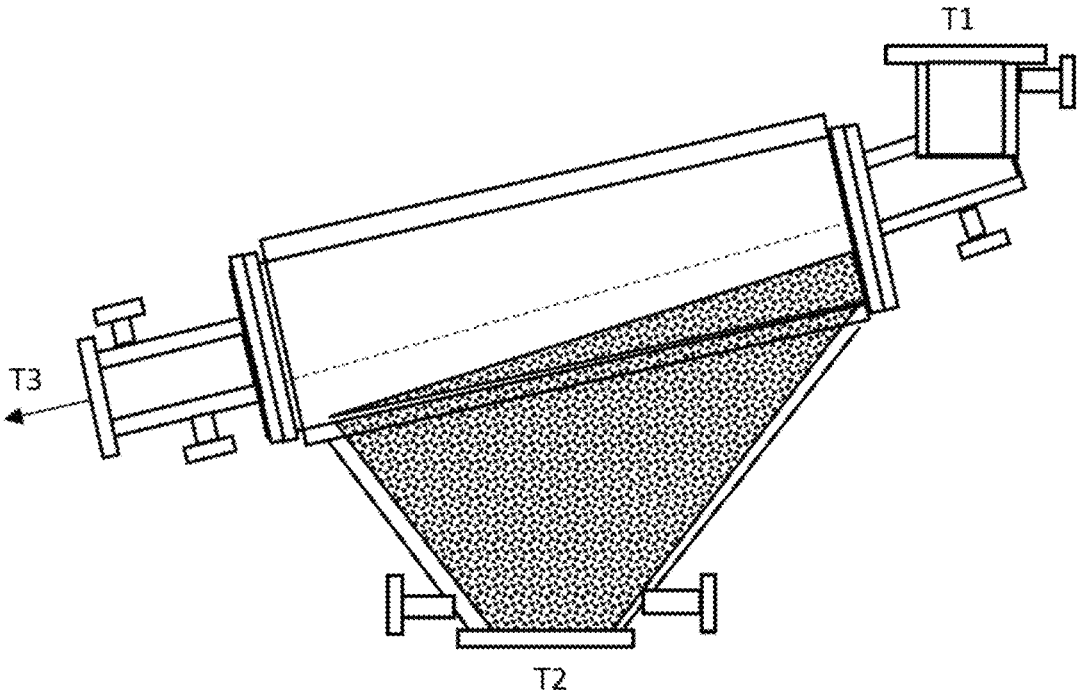
FIG. 4 shows an example of a reactor sieving according to a particular embodiment of the method that is the object of the present invention.

FIG. 4 shows an example of sieving during the step of separating the heat-transfer beads and the pyrolyzed ligneous particles.

A separation grille consisting of parallel metal bars is used for separating the beads and the biocarbon coming from the pyrolysis reactor at the inlet T1. The space between the bars enables the biocarbon to flow by gravity effect or by means of a pressure-variation device at T2 through the grille and enables the beads to roll towards the inlet of the regenerator at T3. This separation grille is inserted in a pipe. According to one example, the grille is inclined by at least 25° with respect to the horizontal, which enables the heat-transfer beads to roll and bounce on the grille while allowing pyrolyzed ligneous particles to detach from the heat-transfer beads.

According to one example, the separator is brought to temperature with hot combustion gas coming from the regenerator in order to maintain the stability of the temperature of the gases in the equipment of the reaction loop. The whole avoiding temperature differences that can create condensation or have a consequence for the chemical composition of bioproducts.

Figure 5:
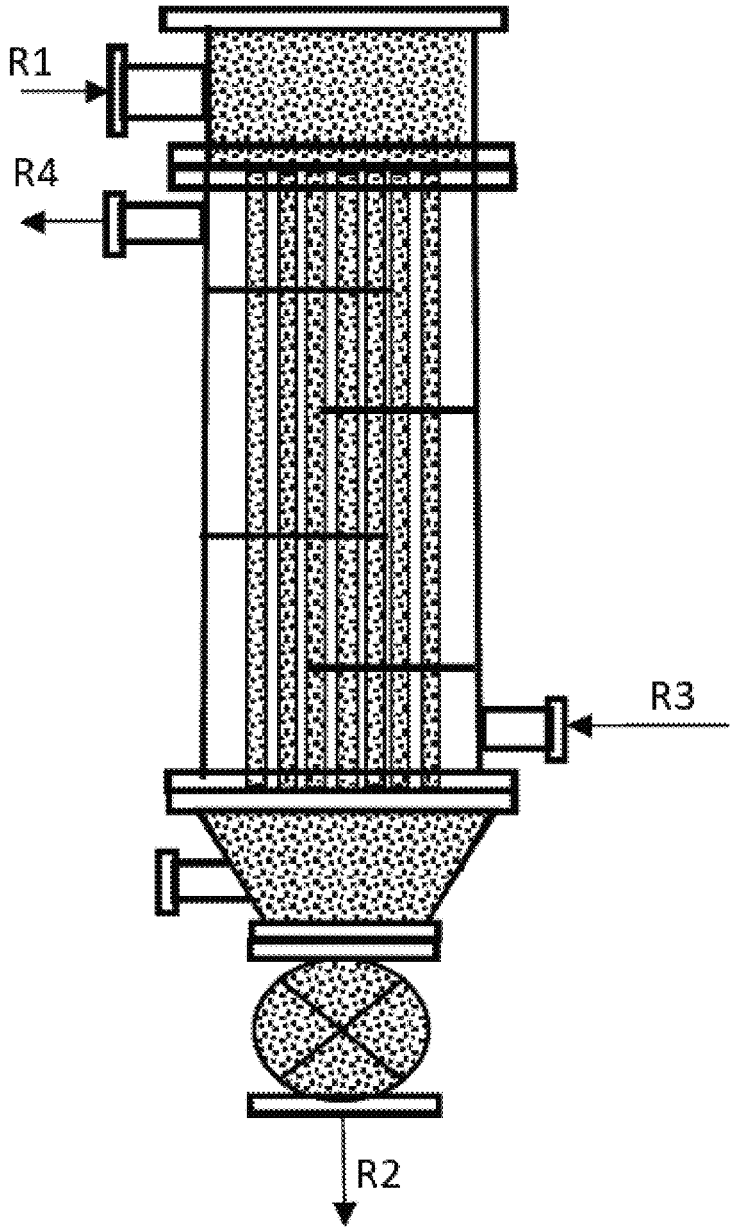
FIG. 5 shows an example of a reactor regenerator according to a particular embodiment of the method that is the object of the present invention.

FIG. 5 shows a regenerator used at the step d) of heating the heat-transfer beads.

The heat-transfer bead regenerator transfers heat energy to the beads that will serve to transfer heat energy to the biomass in the pyrolysis reactor.

Once the energy of the beads has been transferred, they are returned to the start of the regenerator to be heated once again.

The regenerator consists of a shell-and-tube exchanger with beads descending slowly through the tubes. The regenerator consists of a main cylinder positioned substantially vertically and through which cylindrical tubes pass positioned substantially vertically inside the cylinder, in which the heat-transfer beads pass. The beads to be heated enter at R1 and leave at R2.

The speed of the beads is controlled by a rotary, guillotine and/or double-flap valve and/or rotary feeder and/or gate and/or butterfly valve etc. at the bottom of the regenerator.

The tubes are heated by a high-temperature combustion gas at the shell side. It enters through an inlet R3 and leaves through an outlet R4.

The invention claimed is:

1. A method for pyrolyzing ligneous biomass, comprising:

mechanically grinding ligneous biomass into ligneous particles of less than 3 $cm^3$;

conveying the ligneous particles to a dryer operating at a temperature of at least 80° C., the dryer being configured to have a moisture level of the ligneous particles of less than 10% at an outlet;

heating the ligneous particles coming from the dryer, in a horizontal-trough pyrolysis reactor having an oxygen level of less than 15%, the horizontal-trough pyrolysis reactor comprising a first inlet for the ligneous particles and a second inlet for heat-transfer beads, the heating is configured to establish a temperature inside the horizontal-trough pyrolysis reactor of between 400° C. and 660° C. and configured to make the ligneous particles react so as to have a first output of a mixture of the heat-transfer beads and pyrolyzed ligneous particles, and a second output of a pyrolysis gas, the residence time in the horizontal-trough pyrolysis reactor is at least 20 seconds;

heating the heat-transfer beads in a bead regenerator, prior to the heat-transfer beads entering the horizontal-through reactor, at a temperature of between 400° C. and 650° C. for at least 40 seconds, the bead regenerator comprising a main cylinder through which cylindrical tubes pass in which the heat-transfer beads pass, wherein the cylindrical tubes are positioned vertically in the bead regenerator.

2. The method of claim 1, further comprising separating the heat-transfer beads and the pyrolyzed ligneous particles by sieving comprising a first outlet for the heat-transfer beads and a second outlet for biocarbon.

3. The method of claim 2, further comprising conveying the mixture of heat-transfer beads and pyrolyzed ligneous particles in a vertical conveyor to the sieving.

4. The method of claim 1, wherein the dryer is a rotary dryer and operates with combustion gases.

5. The method of claim 1, wherein the heat-transfer beads are made from metal or ceramic having a diameter greater than 3 mm.

6. The method of claim 5, wherein the heat-transfer beads comprise at least two different diameters with a diameter ratio of less than or equal to 0.5.

7. The method of claim 1, further comprising condensation of the pyrolysis gas conveyed from the horizontal-trough pyrolysis reactor to extract liquid phases.

8. The method of claim 1, wherein the horizontal-trough pyrolysis reactor comprises a storage zone to temporarily store the pyrolysis gas, wherein the storage zone is at least equal to 30% of a total volume of the horizontal-trough reactor.

* * * * *